US006418765B1

(12) United States Patent
Chiu

(10) Patent No.: US 6,418,765 B1
(45) Date of Patent: Jul. 16, 2002

(54) MOTOR-DRIVEN LOCK

(76) Inventor: Ming-Hsiang Chiu, No. 8-22, Hsin Chuang, Mei-Yuan Li, West Dist., Chiayi City (TW)

( * ) Notice: Subject to any disclaimer, the term of this patent is extended or adjusted under 35 U.S.C. 154(b) by 0 days.

(21) Appl. No.: 09/609,462

(22) Filed: Jul. 3, 2000

(51) Int. Cl.[7] ..... E05B 47/00
(52) U.S. Cl. ..... 70/279.1; 70/277; 70/278.2
(58) Field of Search ..... 70/279.1, 277, 70/278.2

(56) References Cited

U.S. PATENT DOCUMENTS 5,018,375 A * 5/1991 Tully ..... 70/472
5,040,391 A * 8/1991 Lin ..... 70/277
5,447,047 A * 9/1995 Lin ..... 70/218
5,473,236 A * 12/1995 Frolov ..... 318/286
5,628,216 A * 5/1997 Quereshi et al. ..... 70/279
5,782,118 A * 7/1998 Chamberlain et al. ..... 70/279
5,987,945 A * 11/1999 Ruano Aramburu ..... 70/277
6,032,991 A * 3/2000 Yeh ..... 292/336.3
6,038,896 A * 3/2000 Chamberlain et al. ..... 70/279.1
6,053,019 A * 4/2000 Wilk et al. ..... 70/283

* cited by examiner

*Primary Examiner*—Michael J. Zanelli
*Assistant Examiner*—Eric M Gibson
(74) *Attorney, Agent, or Firm*—Thorp Reed & Armstrong, LLP

(57) ABSTRACT

The motor-driven lock has an inner part installed on a door of a room, an outer part installed on the door exterior of the room, and a latch. A tube-like releaser covers a barrel, and a part of which is integrated with an inner handle. Another part of the releaser is inserted in a loophole defined in a cover of the inner part of the lock and is connected to a linking tube for unlocking the latch. When using a magnetic card, a key, or a password the lock of the invention is lockable from an exterior of the room, and in addition to being unlockable from the exterior, it is also able to be unlocked from an interior of the room by rotating the releaser.

8 Claims, 5 Drawing Sheets

MOTOR-DRIVEN LOCK

BACKGROUND OF THE INVENTION

1. Field of the Invention

The invention relates to a motor-driven lock, especially to a motor-driven lock which is able to be released from an interior of a room where the lock is installed, as well as is unlockable by a magnetic card, a key, or a password from an exterior of the room.

2. Description of Related Art

Motor-driven locks are able to be conveniently released by a magnetic card, key, or password so they are more and more popular these days. But present motor-driven locks have an obvious drawback: once they are locked from an exterior, they cannot be released from within a room behind a door on which this kind of lock is fitted.

SUMMARY OF THE INVENTION

The object of the invention is to provide a motor-driven lock which, when locked from an exterior, is also able to be unlocked from within a room behind a door on which the lock is installed.

Other objects, advantages and novel features of the invention will become more apparent from the following detailed description when taken in conjunction with the accompanying drawings.

DETAILED DESCRIPTION OF THE PREFERRED EMBODIMENT

Figure 1:
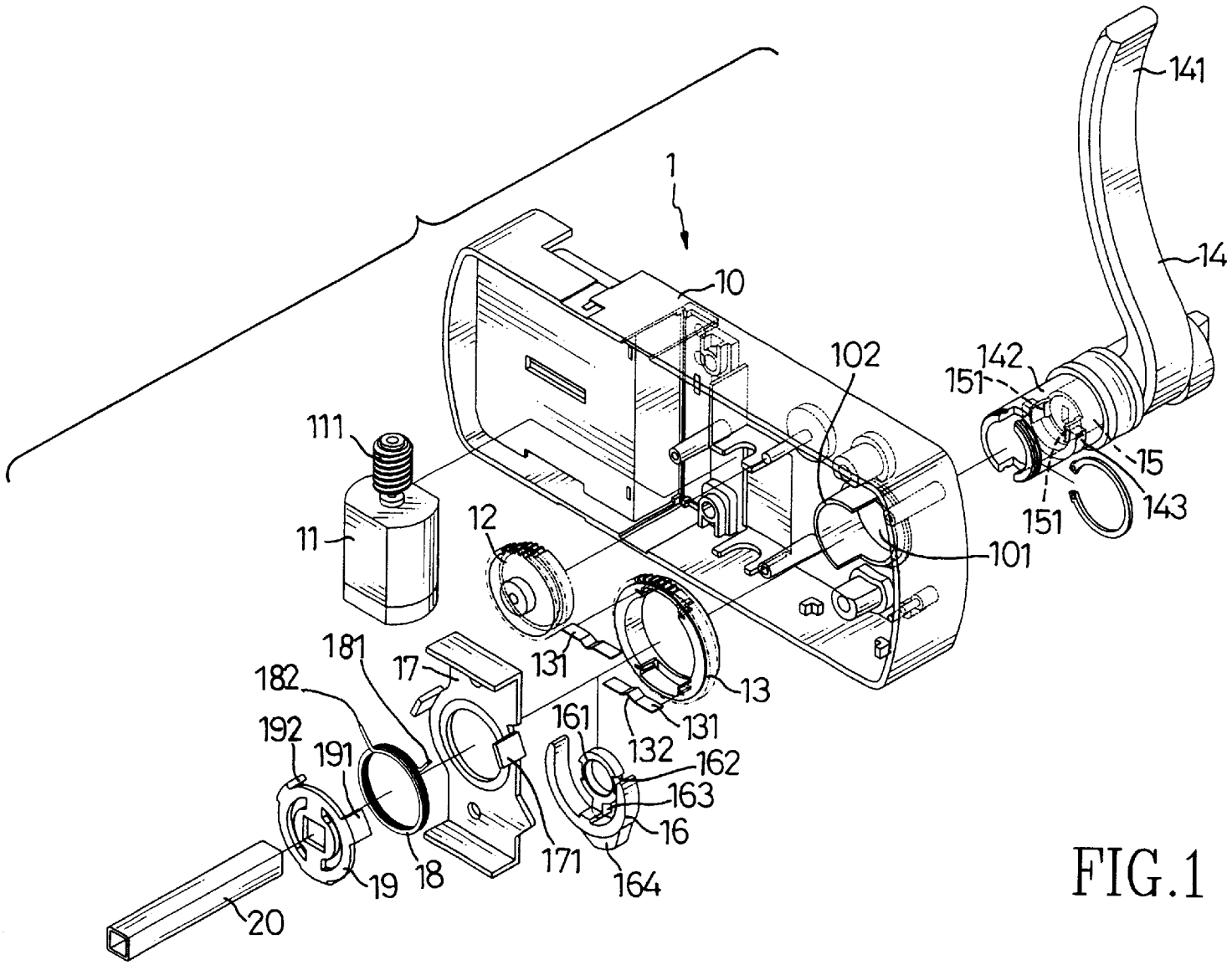
FIG. 1 is an exploded perspective view of an inner part of a lock in accordance with the invention.
Figure 3:
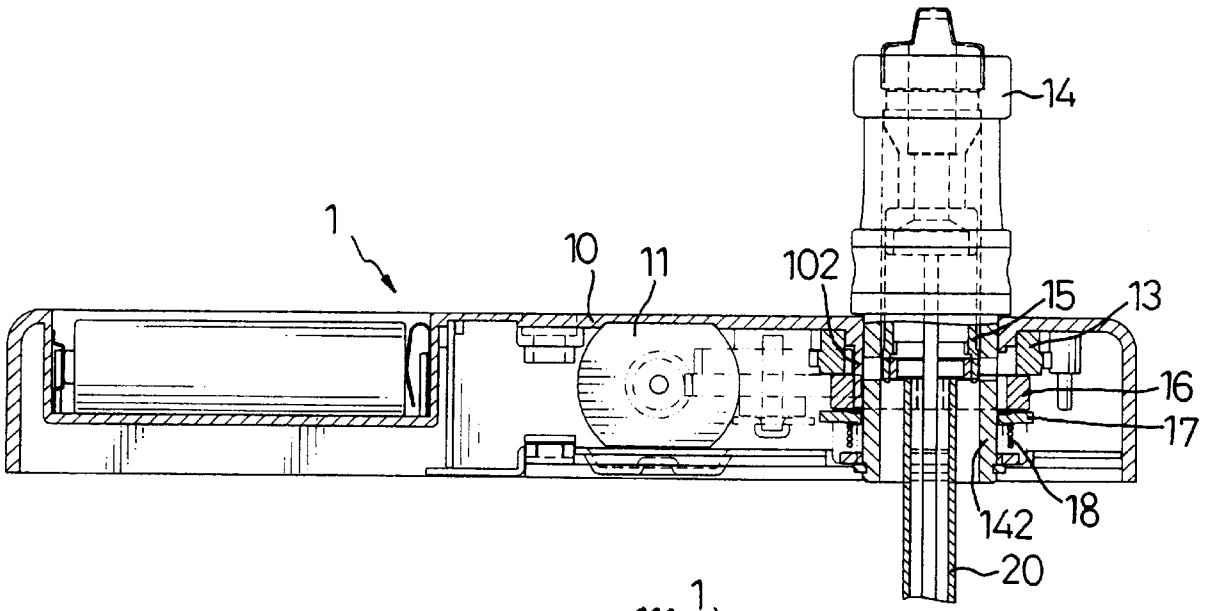
FIG. 3 is a top cross sectional view of the lock of the invention.
Figure 2:
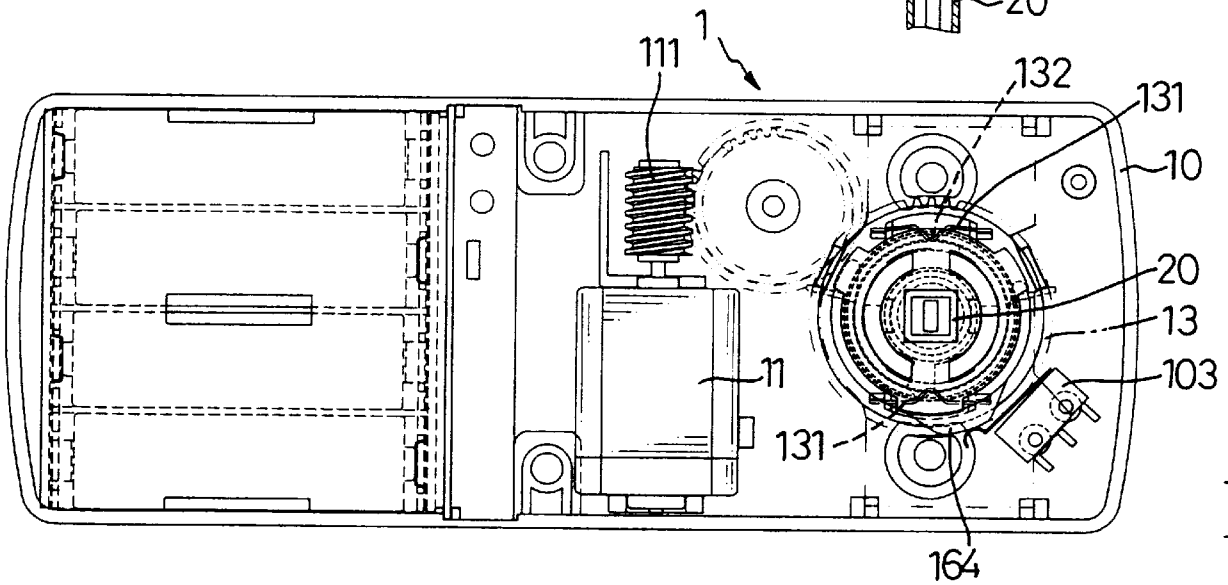
FIG. 2 is a rear view of an interior of the lock of the invention.

With reference to FIGS. 1, 2, and 3, the preferred embodiment of the invention, a motor-driven lock, is shown. The lock has an inner part (1) installable on an interior face of a door of a room, an outer part installable on an exterior face of the door, and a latch (the latter two are not shown in the figs.). The outer part and the latch of the lock are prior arts and not the emphasis of the invention and therefore will not be described herein.

The inner part (1) of the lock has a cover (10) installable on an interior face of a door of a room. A loophole (101) is defined in the cover (10). A wall (102) of semi-circular is formed on a periphery of the loophole (101) and extends inward.

A motor (11) is fixed in the cover (10) and has a worm (111) longitudinally installed on a shaft thereof. The worm (111) is able to drive a gear (12) engaging therewith, which, in turn, drives a ring (13) having an outer gear surface. The ring (13) has at least one inner wall recess in which an elastic strip (131) is placed. In this embodiment of the invention, the ring (13) has two opposite inner wall recesses and two corresponding strips (131) respectively placed in the recesses. A central portion of each strip (131) is curved up to form a nib (132) facing a center of the ring (13). A linker (16) in a form of half ring is provided. A central tube (161), a diameter of which is smaller than that of the linker (16), is formed on the linker (16) with a side longitudinal bar (163) being formed on an end face of the central tube (161). The central tube (161) is on one side of the linker (16). A side protrusion (164) is formed on an outer surface of the linker (16).

An inner handle (14) is provided having a handle bar (141) and a barrel (142) being integrated with the handle bar (141) and extending perpendicularly therewith. A side slit (143) is defined in the barrel (142). A releaser (15) that is tube like covers the barrel (142) and has an inner part further extending into the barrel (142).

In assembly, the barrel (142) is inserted through the loophole (101) and the ring (13) is put onto the wall (102). Then the central tube (161) of the linker (16) is inserted through the side slit (143). The central tube (161) is able to securely engage with the releaser (15) by a pair of recesses (162) defined in an outer side wall thereof receiving respectively therein one of two protrusions (151) formed on the inner part of the releaser (15). Then a support plate (17) having a left leg (171), a right leg (172) and an opening (173) is put onto the barrel (142) with the opening (173) thereof covering on an end of the barrel (142). A cap (19) having a left ear (191) and a right ear (192) is put on the support plate (17). A bias spring (18) is installed between the support plate (17) and the cap (19) with a left end (181) thereof rests on upper edges of the left leg (171) of the support plate (17) and the left ear (191) of the cap (19), and a right end (182) thereof rests on the right leg (172) and the right ear (192). When the lock is released, the door is able to be opened by rotating the handle bar (141). If the handle bar (141) is rotated, for example, leftward, the left ear (191) of the cap (19) will push the left end (181) of the bias spring (18); the right end (182) of the bias spring (18) will keep still because it is blocked by the right leg (172) of the support plate (17). When the handle bar (141) is freed, the bias spring (18) then will push the left ear (191) back. The cap (19) has a central opening defined for containing a linking tube (20). The linking tube (20) is connected to the releaser (15) by a long plate, as more clearly shown in FIG. 3. Rotation of the liking tube (20) is able to drive the latch to make the lock released.

Figure 4:
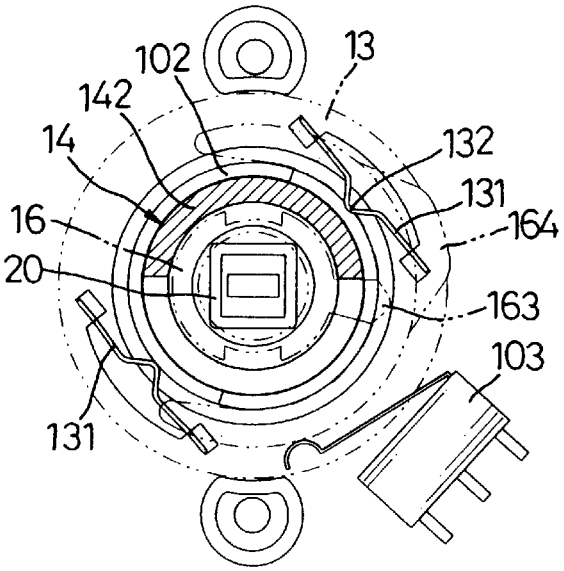
FIGS. 4 to 7 are cross sectional views of part of the lock of the invention showing the operation of the invention.
Figure 5:
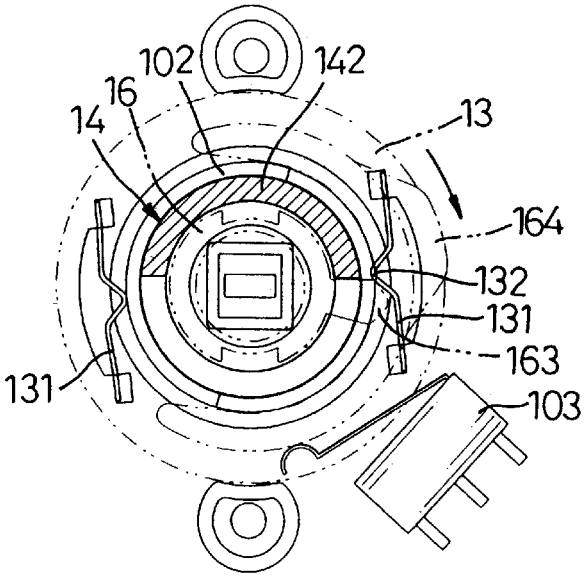
Figure 6:
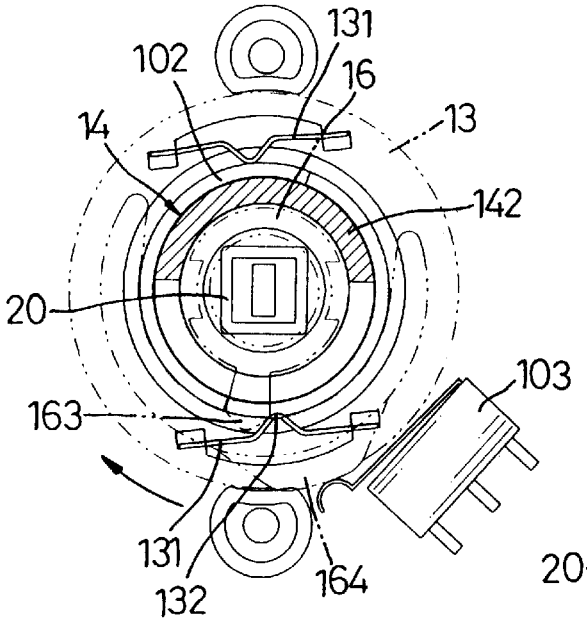
Figure 7:
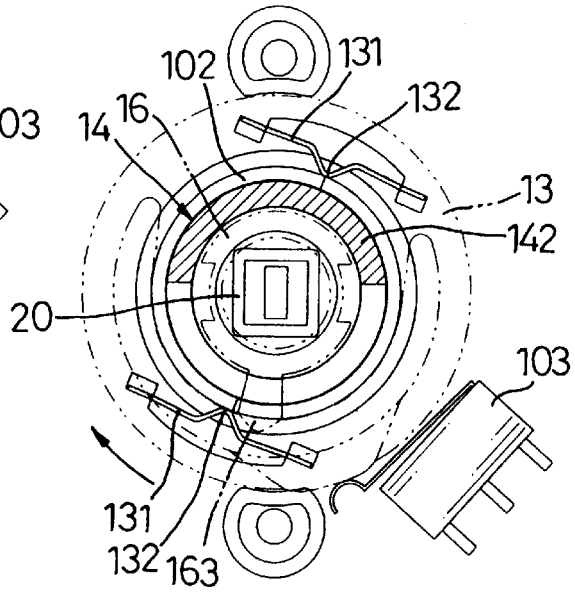

When the door employing the lock of the invention is locked from an exterior of the room, it is able to be released either by a magnetic card, a key, or password outdoors, or by rotation of the releaser (15) from interior of the door. As shown in FIG. 4, in the latter case, a user in a room behind the door can rotate the releaser (15). Then the releaser (15) will drive the long plate connected thereto to rotate the linking tube (20), and the lock will be released. In the former case, the motor (11) will be actuated and drive the worm (111), then the gear (12) and then the ring (13). As shown in FIG. 5, when one of the nibs (132) meets the longitudinal bar (163), it will drive the linker (16) to rotate. Since the linker (16) firmly engages with the releaser (15), the latter will then be driven to rotate. As described above, the rotation of the releaser (15) will finally drive the linking tube (20) to release the lock. The rotation of the linker (16) will finally be stopped when the longitudinal bar (163) meets an edge of the wall (102), as shown in FIG. 6. At this time, the side protrusion (164) will meet a microswitch (103). The microswitch (103) will then actuate a logic circuit (not shown in the figs.) to keep rotating the linker (16) for a certain distance until the nib (132) is moved onto the semicircular wall (102) and will not affect locking of the lock.

Figure 8:
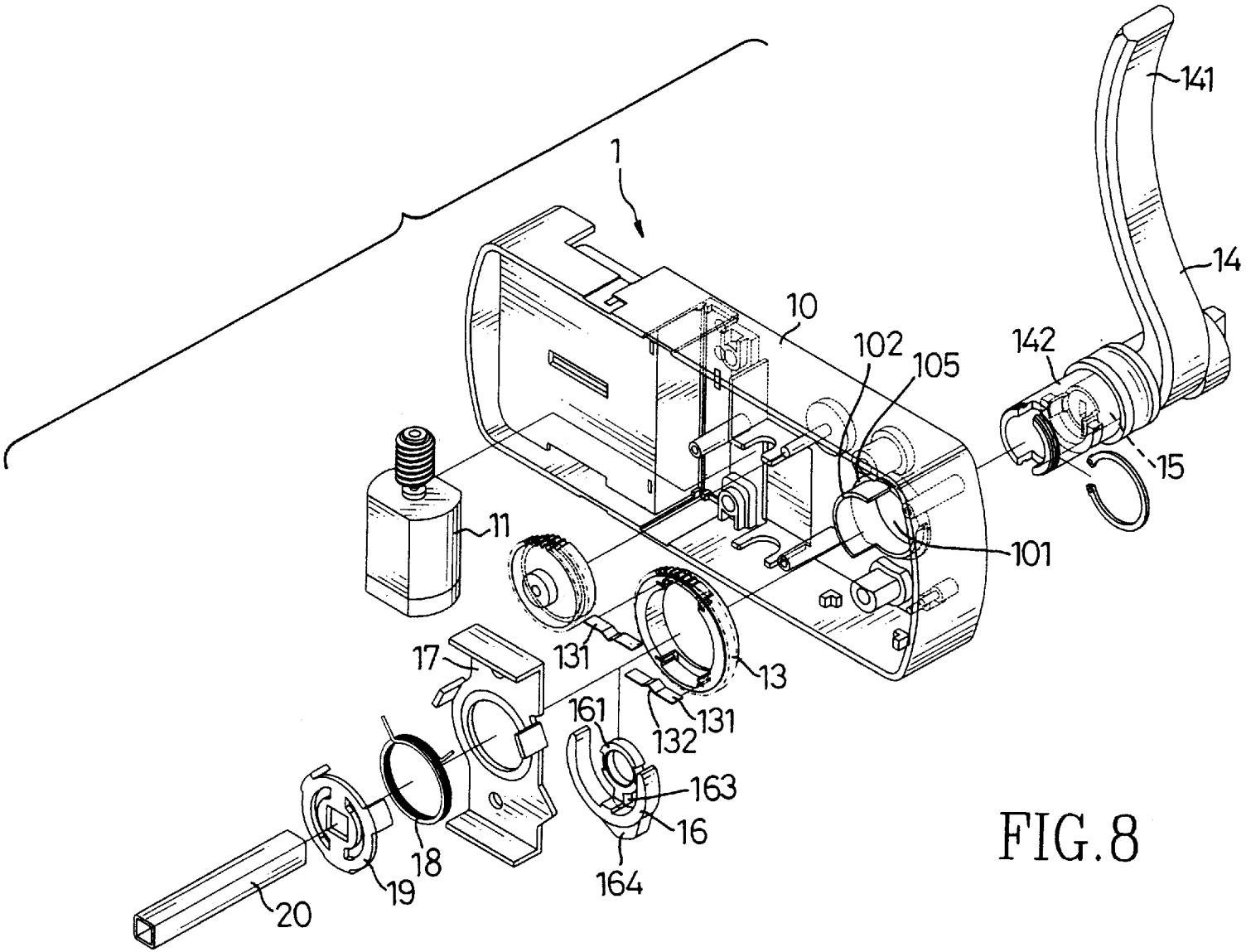
FIG. 8 is an exploded perspective view of another embodiment of the invention; and, FIGS. 9 and 10 are cross sectional views of part of the lock shown in FIG. 8 showing the operation of the embodiment shown in FIG. 8.
Figure 9:
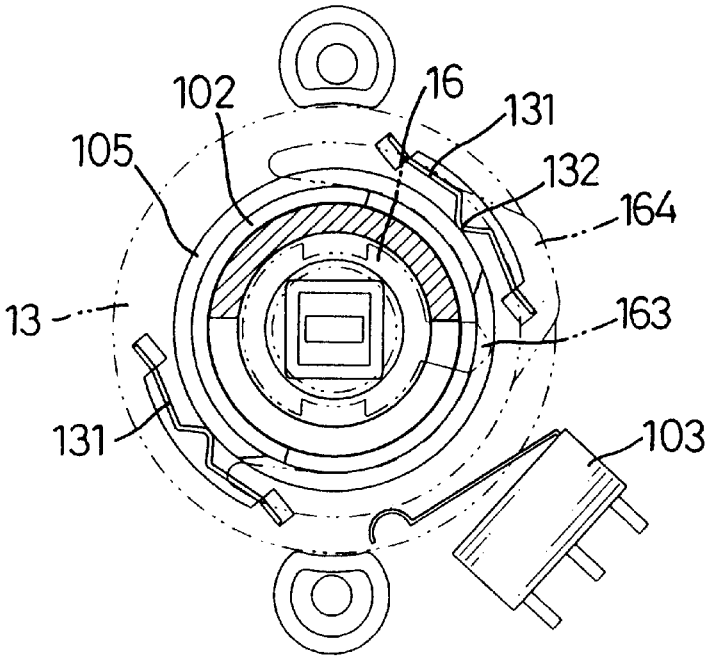
Figure 10:
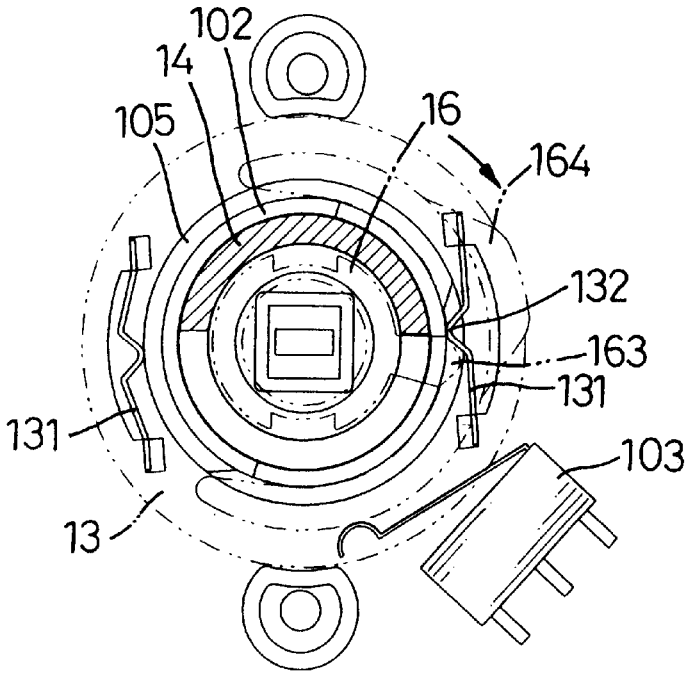

When the lock is released, the door can be opened in the room by rotating the handle bar (141). As shown in FIG. 4, if the handle bar is rotated at this time, the linker (16) securely connected therewith must rotate accordingly. Then the side protrusion (164) will drive the nib (132) to rotate. Although the strip (131) having the nib (132) formed thereon is elastic, such an interference between the linker (16) and the nib (132) will inevitably lower a service life the strip (131). To resolve this problem, another embodiment of the invention as shown in FIGS. 8, 9, and 10 is provided. In this embodiment, an outer wall (105) of semi-circular is provided covering on the semi-circular wall (102). As shown in FIG. 9, the nib (132) is now resting on an outer surface of the outer semi-circular wall (105) instead of the semi-circular wall (102) and therefore the rotation of the linker (16) will no longer affect the nib (132). However as shown in FIG. 10, releasing the lock by magnetic card, key, or password out of the door will nevertheless make the nib (132) drive the linker (16) to release the lock.

From the above description, it is noted that compared with the conventional motor-driven locks, the invention is able to be released from within a room after the lock has been locked from an exterior of the room, which will bring convenience for users.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electric motor-driven lock having an inner part installed on an interior face of a door of a room, an outer part installed on an exterior face of the door, and a latch, wherein the improvement comprises:

the inner part having a cover, an inner handle, and a motor, the cover having a loophole, the inner handle having a handle bar, a barrel formed on the handle bar and being inserted through the loophole, and a releaser installed on the barrel, the motor being able to drive a linker engaging with the releaser via a ring covering on a semi-circular wall, the barrel being inserted through an opening defined in a support plate on which a bias spring is installed by means of a cap, a linking tube being connected to the releaser by a long plate and wherein when the lock is locked, it is able to be released exterior of the room either by a magnetic card, a key, or a password outdoor or rotating the releaser via an interior of the room.

2. The electric motor-driven lock as claimed in claim 1, wherein the wall is formed extending inward on a periphery of the loophole, at least one elastic strip is installed in a recess defined in the ring, a side slit is defined in the barrel of the handle to receive therethrough the linker, and a side protrusion is formed on an outer surface of the linker.

3. The electric motor-driven lock as claimed in claim 2, wherein a central portion of each strip is curved up to form a nib facing a center of the ring.

4. The electric motor-driven lock as claimed in claim 1, wherein the motor has a worm longitudinally installed on a shaft thereof to drive the ring via a gear.

5. The electric motor-driven lock as claimed in claim 1, wherein a microswitch is installed in the cover, and is actuable by the side protrusion when the side protrusion rotates.

6. The electric motor-driven lock as claimed in claim 1, wherein a central tube of the linker is securely engagable with the releaser by a pair of recesses defined in an outer side wall thereof and a pair of corresponding protrusions formed on an inner part of the releaser.

7. The electric motor-driven lock as claimed in claim 1, wherein a bias spring is installed between the support plate and the cap with a left end thereof rests on upper edges of the left leg of the support plate and the left ear of the cap, and a right end thereof rests on the right leg and the right ear.

8. The electric motor-driven lock as claimed in claim 2, wherein a semi-circular outer wall is provided covering on said wall.

* * * * *